United States Patent [19]

Kasiwade

[11] Patent Number: 4,636,800

[45] Date of Patent: Jan. 13, 1987

[54] APPARATUS FOR ROTATING AND DRIVING ANTENNA DEVICE

[75] Inventor: Yoshiaki Kasiwade, Kawasaki, Japan

[73] Assignee: Kabushiki Kaisha Daiwa Industry, Tokyo, Japan

[21] Appl. No.: 555,380

[22] Filed: Nov. 28, 1983

[51] Int. Cl.[4] ..... H01Q 3/02

[52] U.S. Cl. ..... 343/766; 74/606 R

[58] Field of Search ..... 343/763–766, 343/882; 74/421 A, 425, 606 R

[56] References Cited

U.S. PATENT DOCUMENTS

| | | | |
|---|---|---|---|
| 2,566,897 | 9/1951 | Koenig | 343/766 |
| 2,581,123 | 1/1952 | Merkle | 343/763 |
| 2,668,920 | 2/1954 | Barrett | 343/766 |
| 2,794,162 | 5/1957 | Lifsey | 343/766 |

*Primary Examiner*—Eli Lieberman

*Attorney, Agent, or Firm*—Robert E. Burns; Emmanuel J. Lobato; Bruce L. Adams

[57] ABSTRACT

An apparatus for rotating and driving an antenna device in a radio transmitter and receiver which can simply increase and decrease the driving torque by variation in weight thereof. This apparatus comprises a rotary body rotatably mounted on a main housing and supporting the antenna device thereabove, and one or more driving units detachably mounted on the main housing. The rotary body is connected to an input gear rotatably provided on the main housing through a gear mechanism. Each of driving units has a driving source and a keyway gear connected through the gear mechanism, the keyway gear being meshed with the input gear when the driving unit is mounted on the main housing. Thereby, the driving torque required for rotation of the antenna device is adjusted by increase or decrease in number of the driving units.

11 Claims, 6 Drawing Figures

APPARATUS FOR ROTATING AND DRIVING ANTENNA DEVICE

FIELD AND BACKGROUND OF THE INVENTION

The present invention relates to an antenna device in a radio transmitter and receiver, and more particularly, to an apparatus for rotating and driving an antenna device to direct an antenna element thereof in a desired direction.

In fishery radios, amateur radios and the like, the position of the other office is unspecified. In order to make an exchange of communication with an optional office of such unspecified offices, it is necessary to release a beam having a directivity towards the object. Therefore, a multi-element antenna device is designed so as to be rotated by a rotating and driving apparatus. On the other hand, it is necessary to release a beam having a sharp directivity towards the object in order to make an exchange of communication with the remote other office. To this end, the number of elements of the antenna device need be increased. Accordingly, the antenna device itself increases in weight and accordingly, the driving torque of the rotating and driving apparatus has to be increased. Thus, there has been used a rotating and driving apparatus having a driving torque corresponding to the weight of each of the antenna devices which are different in weight. Therefore, it is necessary to prepare the rotating and driving apparatus corresponding to the weight of each of the antenna devices. In the case where the number of antenna elements of the existing antenna device is increased or decreased, the rotating and driving apparatus has to be exchanged and thus the existing antenna device needs to be disassembled, which requires labors and is uneconomical.

SUMMARY OF THE INVENTION

It is an object of the present invention to provide an apparatus for rotating and driving an antenna device which can extremely easily increase and decrease the driving torque in accordance with an increase and decrease in weight of the antenna device.

It is a further object of the present invention to provide a rotating and driving apparatus wherein a rotating and driving apparatus attached to an antenna device comprises a plurality of attachable driving units, and the antenna device is rotated and driven by a driving force of a single driving unit or by superposing the driving forces of a plurality of driving units.

In accordance with the present invention, there is provided an apparatus for rotating and driving an antenna device comprising a main housing, a rotary body rotatably mounted on the main housing and on which the antenna device is mounted, an input gear rotatably supported within the main housing, a first gear mechanism for rotating the rotary body by the rotation of the input gear, and one or more driving units detachably mounted on the main housing, the driving units each having a driving source and a keyway gear driven by the driving source and meshed with the input gear in the final stage.

In a preferred embodiment of the present invention, the input gear is coaxially provided within a bottomed cylinder secured within the main housing and a shaft of the input gear is axially formed in an upper circumferential surface thereof with teeth. The teeth are connected through an intermediate gear to an internal gear formed in the inner circumferential surface of the rotary body. The side of the bottomed cylinder has a portion at which the input gear is positioned, the portion being notched into plural portions, from which the input gear is exposed. Thus, the keyway gear of the driving unit can be meshed with the input gear at the notched portions.

In the apparatus for rotating and driving the antenna device of the present invention, the plurality of driving units composed of a driving portion and a gear mechanism are detachably connected to the rotary body rotated while supporting a rotary shaft of the antenna in such a way that the number of such units may be increased or decreased as necessary. Accordingly, it is not necessary to prepare a rotating and driving apparatus having a different driving torque in accordance with the weight or kind of the antenna device as encountered in the prior art, but the mere preparation of a plurality of driving units will suffice whereby the apparatus may be applied to various antenna devices. Also, where the antenna elements are increased or decreased in the existing antenna device, it is not necessary to remove the rotating and driving apparatus to exchange with a new rotating and driving apparatus having a desired driving torque. In the pressent invention, setting of the driving torque required for the antenna device can be extremely easily accomplished by an increase or decrease of the number of driving units. Accordingly, the present apparatus is extremely advantageous from an economical point and in addition, since the driving unit can be mounted or removed externally, the handling and use thereof are extremely convenient.

DESCRIPTION OF THE PREFERRED EMBODIMENT

Figure 1:
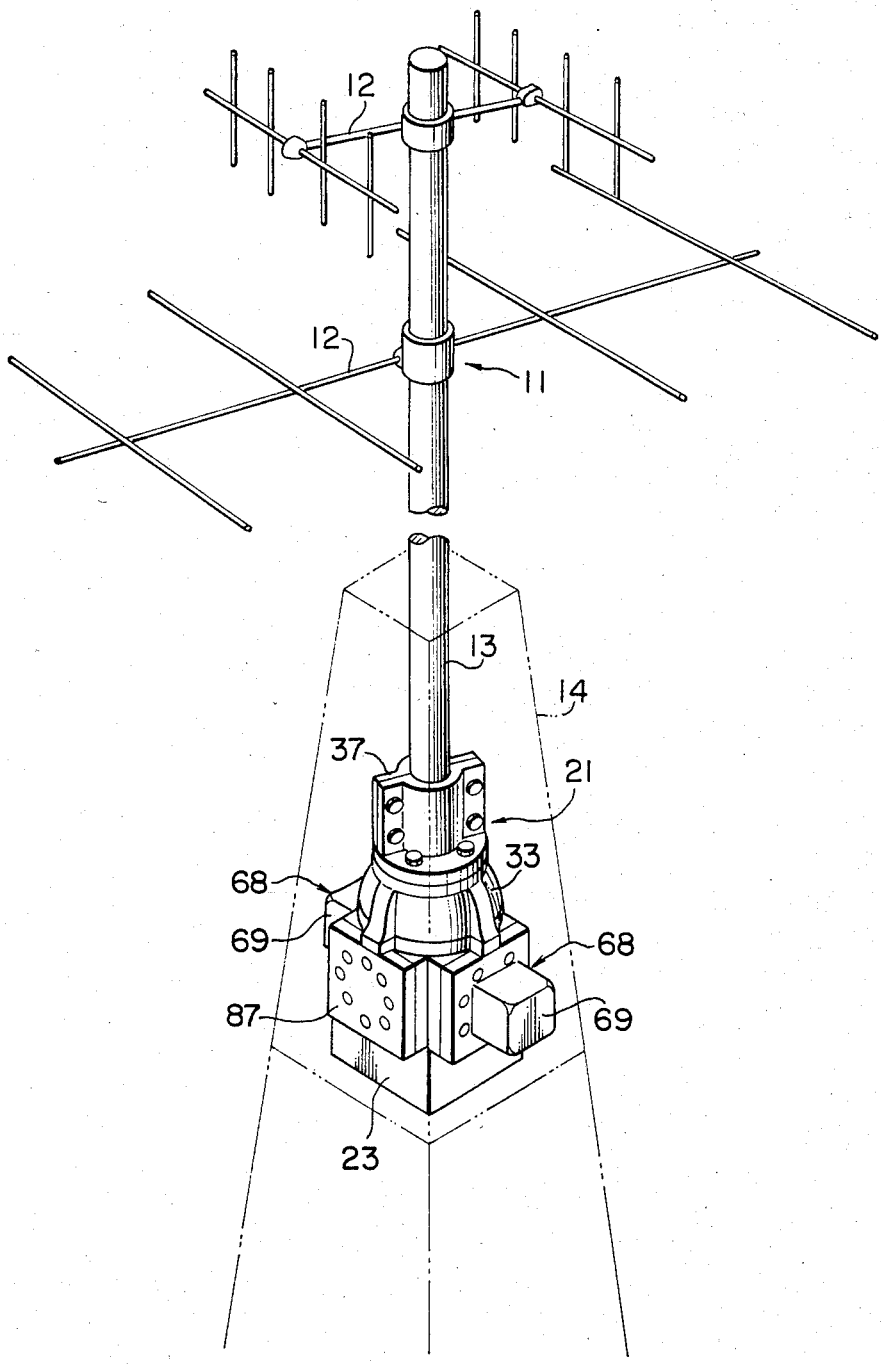
FIG. 1 is a perspective view showing an antenna device provided with a rotating and driving apparatus in accordance with the present invention.
Figure 2:
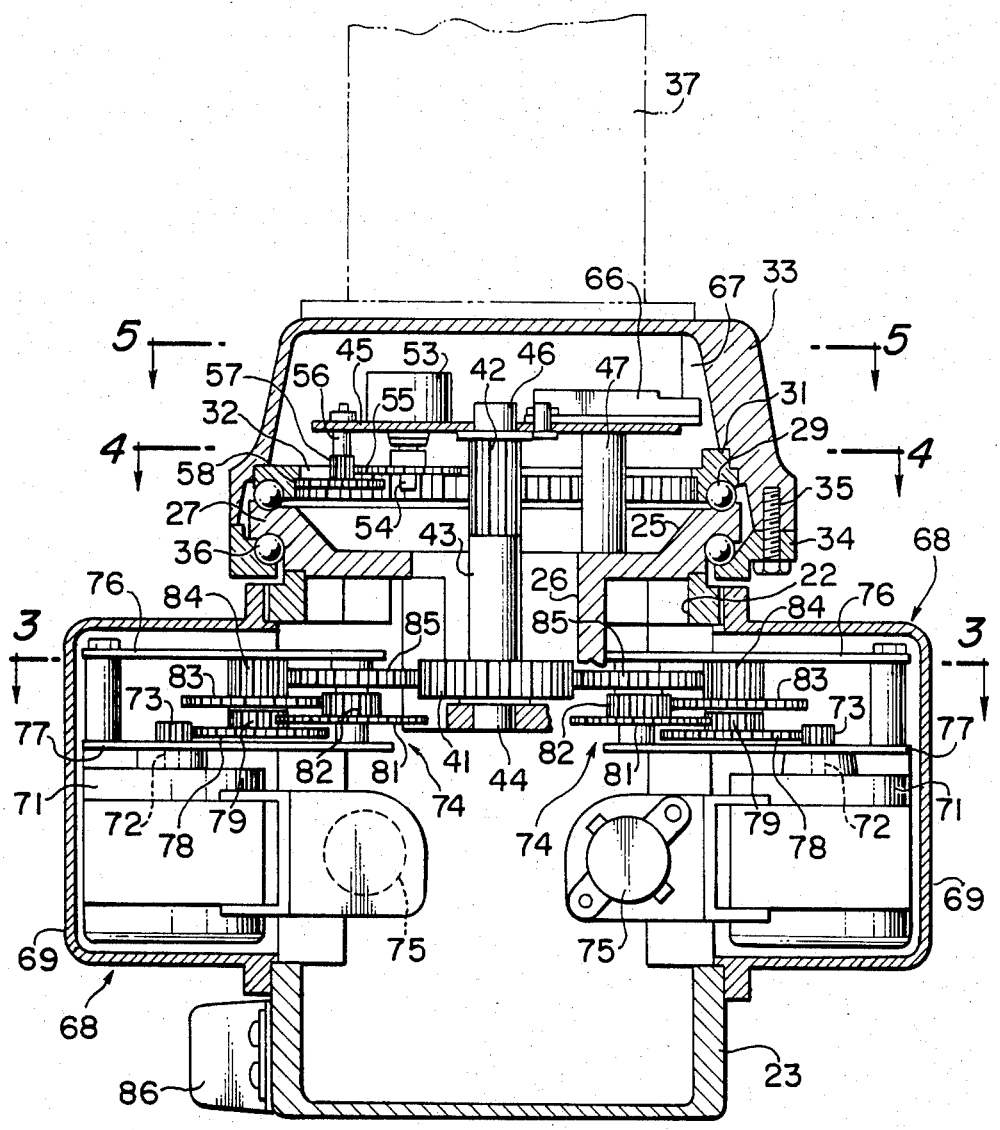
FIG. 2 is a longitudinal sectional view showing one embodiment of the rotating and driving apparatus in accordance with the present invention with a part thereof omitted.
Figure 3:
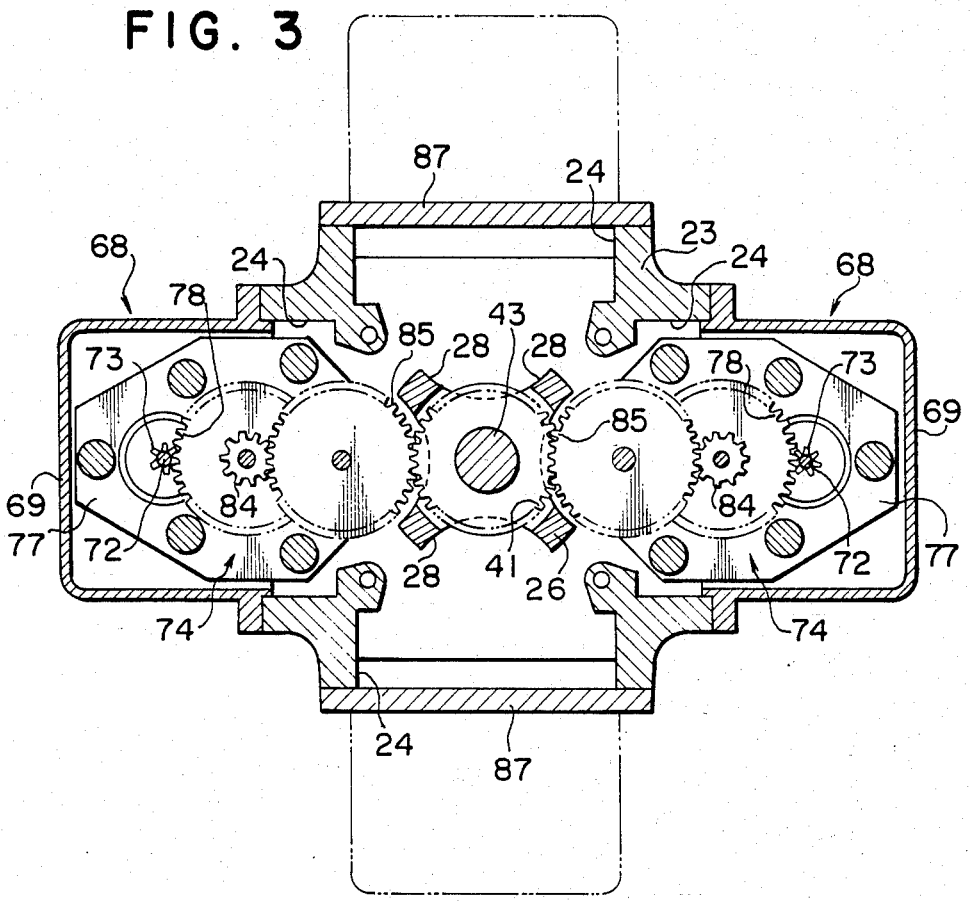
FIG. 3 is a cross sectional view taken on line 3—3 of FIG. 2.
Figure 6:
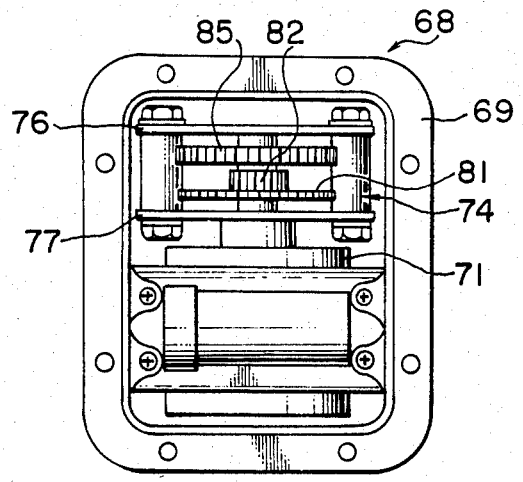
FIG. 6 is a side view showing a driving unit.

In FIG. 1, an antenna device is generally indicated at 11. This antenna device is composed of a plurality of antenna elements 12 and a rotary shaft 13 which is rotated together with the antenna elements 12. The lower end of the rotary shaft 13 is mounted on a rotating and driving apparatus 21 of the present invention provided interiorly and at the upper part of an antenna brace 14 as indicated by the dash-dotted contour lines.

Next, the rotating and driving apparatus 21 of the present invention will be described. There is provided a main housing 23 comprising a bottomed hollow cylindrical body having an opening 22 formed in the upper surface thereof. The main housing 23 is formed in its circumferential surface with four side openings 24 of the same shape in a spaced relation of 90°. Into the main housing 23 is inserted and secured an internal cylindrical body 27 having an upper flange 25 having an opening in the center thereof and a bottomed cylindrical body 26 downwardly extending from the opening. The outer circumferential portion of the upper flange 25 comes into abutment with the opening 22 of the main housing 23, and the upper surface of said outer circumferential portion is upwardly projected. The cylindrical body 26 is formed in its side with four notched windows 28 in a spaced relation of about 90°, the notched windows 28 being positioned opposite side openings 24, respectively. A rotary ring 31 is provided through a ball bearing 29 on an upper outer circumferential portion of the upper flange 25. The rotary ring 31 is formed in its inner circumferential surface with an internal gear 32, the rotary ring 31 being secured in the neighbourhood of a lower opening of an inverted recessed rotary cylindrical body 33. A ring-like frame 34 inwardly projected and opposite the outer circumferential lower surface of the upper flange 25 is secured to a lower open line of the rotary cylindrical body 33 by means of a screw 35. A ball bearing 36 is provided between the frame 34 and the upper flange 25. With this arrangement, the rotary cylindrical body 33 is mounted so that it may not be moved vertically but may be rotated horizontally with respect to the upper flange of the internal cylinder 27. A bracket 37 for mounting the rotary shaft 13 of the antenna device is secured to the upper surface of the rotary cylindrical body 33.

Figure 4:
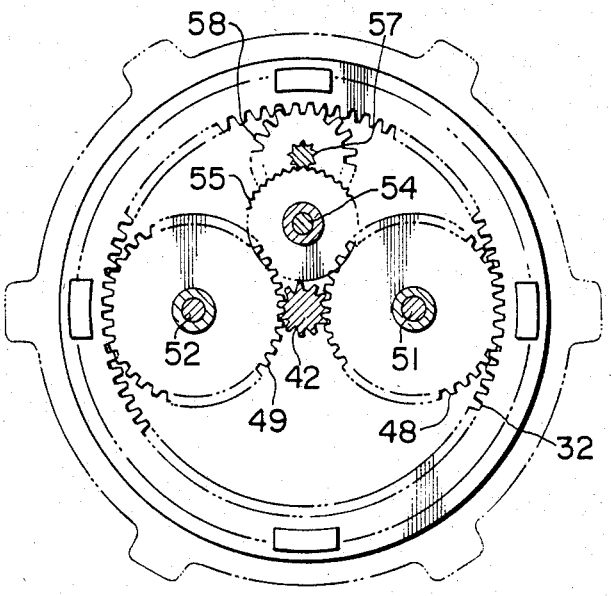
FIG. 4 is a cross sectional view taken on line 4—4 of FIG. 2.

The cylindrical body 26 of the internal cylinder 27 is provided at its lower part with an input gear 41 having a diameter slightly smaller than an inside diameter of the cylindrical body 26, the input gear 41 being mounted on a main shaft 43 axially formed at its upper portion with a gear 42. The lower end of the main shaft 43 is supported on a bearing 44 provided on the bottom of the cylindrical body 26. The upper end of the main shaft 43 is supported on a bearing 46 provided on a support board 45 positioned within the rotary cylinder 33. The support board 45 is secured through a brace 47 to the upper flange 25 of the internal cylinder 27. As shown in FIG. 4, two intermediate gears 48, 49 are engageably interposed in a spaced relation of approximately 180° between the main shaft 43 and the internal gear 32 of the rotary ring 31. Though not shown, shafts 51, 52 of the intermediate gears 48, 49 are supported between the support board 45 and the upper flange 25. Thereby, the rotation of the main shaft 43 is transmitted to the internal gear 32 to rotate the rotary cylindrical body 33.

A rotary variable resistor 53 for detecting the direction of the antenna is secured onto the support board 45. A gear 55 is mounted on a rotary shaft 54 of the variable resistor 53 projected downwardly of the support board 45, and the gear 55 is meshed with axial teeth 57 formed in the inner circumferential surface of a shaft 56. The shaft 56 has its upper end rotatably supported on the support board 45 and has its lower end provided with a gear 58 meshed with the internal gear 32 of the rotary ring 31 to transmit rotation of the rotary cylinder 33 to the rotary shaft 54 of the variable resistor 53.

Figure 5:
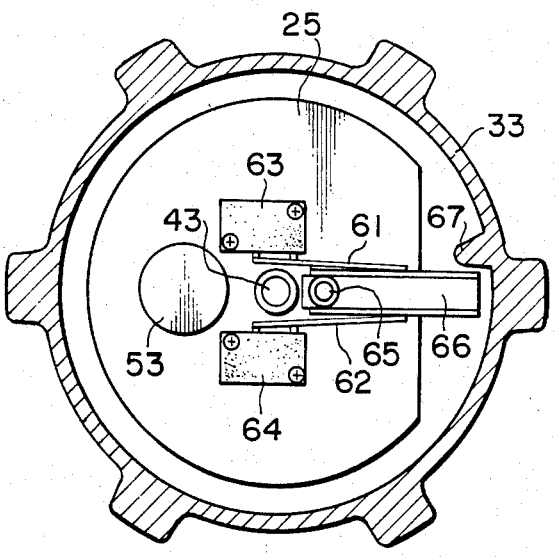
FIG. 5 is a cross sectional view taken on line 5—5 of FIG. 3.

As shown in FIG. 5, switches 63, 64 having operating joints 61, 62 are mounted on the support board 45. The operating joints 61, 62 are positioned opposite each other, between which is positioned a pivotable lever 66 having one end pivotally mounted on a shaft 65 which is in turn secured to the support board 45. The pivotable lever 66 has a free end extended in a direction of the inner surface of the rotary cylindrical body 33 and placed in abutment with a projection 67 projected towards the inner surface of the rotary cylindrical body 33. That is, when the rotary cylindrical body 33 is rotated through approximately one full rotation counterclockwise in FIG. 5, the projection 67 comes into abutment with the pivotal lever 66 to pivotally move the pivotable lever 66 counterclockwise. Thereby the operating joint 61 is pressed and the switch 63 actuates. When the rotary cylinder 33 is rotated through approximately full rotation clockwise from this state, the projection 67 causes the lever 66 to pivotally move clockwise and the switch 64 is actuated by the operating joint 62. By the switching operation of these switches 63, 64, a driving unit later described can be switched in normal and reverse modes.

One or more driving units 68 are detachably mounted corresponding to the total weight of the antenna elements to be rotated on the side opening 24 of the main housing 23. In the illustrated embodiment, two driving units 68 are provided, each being mounted on a pair of opposed side openings 24, respectively.

Each of the driving units 68 is housed in a unit case 69 having an opening of substantially the same size as the side opening 24. The unit case 69 is internally provided with a reversible motor 71, a gear 73 mounted on an output shaft 72 of the motor 71, and a reducing gear box 74 interposed and meshed between the input gear of the main shaft 42. A capacitor 75 for starting the motor 71 is also incorporated into the unit case. The gear box 74 is composed of a group of gears supported between supports supported in parallel within the unit case 69.

That is, the gear box 74 is composed of a large-diameter gear 78 meshed with the gear 73 of the motor 71, a small-diameter gear 79 mounted coaxial with the gear 78, a large-diameter gear 81 meshed with the small-diameter gear 79, a small-diameter gear 82 mounted coaxial with the gear 81, a large-diameter gear 83 meshed with the small-diameter gear 82, a small-diameter gear 84 mounted coaxial with the gear 83 and a large-diameter keyway gear 85 meshed with the gear 84. A part of the keyway gear 85 is meshed with the input gear 41 through the notched window 28 of the inner cylindrical body 26. While in this embodiment, an electric motor 71 is provided as a driving source, it will be noted that instead, an electromagnetic operating body in which a movable portion is reciprocated, a ratchet mechanism for converting reciprocating motion of the movable portion into rotational motion and a crank mechanism can be used. A cover 87 is mounted on the side opening 24 on which the driving unit 68 is not mounted. A power connector 86 for the motor 71 is provided at the lower part of the main housing 23.

In the following, the operation of the antenna driving device will be described. When a power supply circuit (not shown) of the motor 71 of the driving unit 68 is energized through the power connector 86 to drive the motor 71, the gear 73 mounted on the ouput shaft 72 is rotated, and the rotation is transmitted to the foremost large-diameter gear 78 of the reducing gear box 74 and thence to the gears 79, 81,82, 83 and 84 whereby the final keyway gear 85 is rotated at a reduced rate. This rotation causes the main shaft 43 to rotate through the input gear 41. The rotation of the main shaft 42 is transmitted to the internal gear 32 of the rotary ring 31 through the intermediate gears 48, 49 meshed with the gear 42 to thereby rotate the rotary cylindrical body 33. The rotation of the rotary cylindrical body 33 rotates the antenna rotating shaft 13 mounted on the rotary cylindrical body 33 through the bracket 37 to change the direction of the antenna elements 12. In this manner, the rotary cylindrical body 33 is rotated to change the direction of the antenna elements 12 to coincide with the direction of the office.

By the rotation of the rotary cylindrical body 33, the rotation of the internal gear 32 is transmitted to the gears 58, teeth 57 and gear 55 to rotate the rotary shaft 54 of the variable resistor 53 and therefore, the rotational direction and angle can be known from the remote location from the variation in resistance resulting from such rotation. When the rotary cylinder 33 is rotated in one direction through approximately one full rotation, the projection 67 projected within the rotary cylinder 33 engages the pivotable lever 66 to press one of the operating joints 61, 62 whereby one of the switches 63, 64 operated by the operating joints is actuated to drive the motor 71 of the driving 68 in a reverse mode to rotate the rotary cylinder 33 in a reverse direction. When the rotary cylinder 33 is rotated through approximately one full rotation in the reverse direction, the other one of the switches 63, 64 is actuated and the motor 71 runs in the normal direction. Accordingly, the rotary cylinder is never rotated continuously in one direction and thus lead wires (not shown) of the antenna elements 12 of the antenna apparatus will not be wound about the rotary shaft 13.

While in the above-described embodiment, two driving units 68 are used to rotate the rotary shaft 13, it will be understood of course that in the event the antenna device is light in weight, one driving unit 68 will suffice. In the event that the antenna device is heavy, another driving unit 68 is mounted on one or both of the remaining two side openings 24 and the antenna device 11 may be rotated and driven by three or four driving units 68. In this manner, the rotary torque of the main shaft 43, that is, the rotary torque of the rotary cylinder 33, can be extremely easily changed by increasing or decreasing the number of the driving units 68 and consequently the apparatus can be applied to various kinds of antenna devices.

Furthermore, while in the above-described embodiment, design is made so that four driving units may be mounted, it will be understood of course that the units are not limited to four in number and the shape of the main housing 23, the position and number of the side opening 24 in the peripheral surface or the number of gears of the gear box 74 of the driving unit 68 can be changed as necessary.

What is claimed is:

1. An apparatus for angularly displacing an antenna device comprising: a main housing having about its circumference a plurality of circumferentially spaced-apart openings; a displaceable body mounted to undergo angular displacement on the main housing and having means for mounting thereon an antenna device during use of the apparatus; an input gear rotatably supported within the main housing and having gear teeth disposed about the periphery thereof, the input gear being positioned so that the gear teeth thereof are proximate the main housing openings; first gear means disposed within the main housing and operative in response to rotation of the input gear to effect angular displacement of the displaceable body; and a plurality of driving units detachably mounted on the main housing at respective ones of the main housing openings and each operative when detachably mounted on the main housing to effect rotational driving of the input gear in the same direction, each driving unit having a unit housing having an opening, means detachably mounting the unit housing on the main housing with the unit housing opening facing the main housing opening, second gear means supported within the unit housing and releasably engageable with the input gear to effect rotational driving thereof in response to driving of the second gear means, and driving means supported within the unit housing for driving the second gear means; whereby the driving torque for rotationally driving the input gear can be selectively varied in dependence on the number of driving units detachably mounted on the main housing.

2. An apparatus according to claim 1; wherein each second gear means includes a toothed gear positioned to make meshing engagement with the toothed input gear when the unit housing is detachably mounted on the main housing.

3. An apparatus according to claim 1; wherein the driving means of each driving unit comprises a reversible motor for driving the second gear means in forward and reverse modes.

4. An apparatus according to claim 3; wherein each driving unit includes actuatable switching means for selecting the forward and reverse driving directions of the reversible motor, and means mounted to undergo displacement with the displaceable body for actuating the switching means.

5. The apparatus according to claim 1, including a shaft connected to said input gear, and said first gear means comprising teeth axially cut on said shaft, said teeth being meshed with internal teeth formed about an internal circumferential surface of said displaceable body through an intermediate gear.

6. The apparatus according to claim 1, wherein said displaceable body has one projection which projects from an inner circumferential surface thereof, and said main housing has a switching device for switching the direction of angular displacement said second gear means of said driving unit to the reverse direction by engagement with said projection.

7. The apparatus according to claim 1, wherein said main housing has a direction detecting means for detecting the direction of angular displacement of said displaceable body.

8. The apparatus according to claim 1, wherein said main housing comprises a closed-bottom cylindrical body.

9. The apparatus according to claim 1, wherein said second gear means comprises a speed reducing mechanism for reducing the speed of rotation from said driving means.

10. The apparatus according to claim 6, wherein said switching device comprises two switch means, and a pivotable member positioned between said two switch means and engageable with said projection to actuate either of said switch means.

11. The apparatus according to claim 7, wherein said direction detecting means comprises a rotary-type variable resistor.

* * * * *